US011195654B2

(12) United States Patent
Schumm et al.

(10) Patent No.: US 11,195,654 B2
(45) Date of Patent: Dec. 7, 2021

(54) IGNITION COIL

(71) Applicant: BorgWarner Ludwigsburg GmbH, Ludwigsburg (DE)

(72) Inventors: Sven Schumm, Walheim (DE); Manfred Adolf, Schwaikheim (DE); Timo Stifel, Freiberg am Neckar (DE); Dirk Wüstenhagen, Auma (DE); Manuel Bauer, Ludwigsburg (DE); Alexander Stark, Althengstett (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 16/685,377

(22) Filed: Nov. 15, 2019

(65) Prior Publication Data

US 2020/0176181 A1 Jun. 4, 2020

(30) Foreign Application Priority Data

Nov. 30, 2018 (DE) ..... 10 2018 130 492.7

(51) Int. Cl.

| | |
|---|---|
| ***H01F 38/12*** | (2006.01) |
| ***H01F 5/04*** | (2006.01) |
| ***H01F 27/32*** | (2006.01) |
| ***H01F 27/02*** | (2006.01) |

(52) U.S. Cl.

CPC ..... *H01F 38/12* (2013.01); *H01F 5/04* (2013.01); *H01F 27/022* (2013.01); *H01F 27/327* (2013.01)

(58) Field of Classification Search

CPC .. F02P 3/02; H01F 5/04; H01F 27/022; H01F 27/327; H01F 38/12

USPC ..... 123/634

See application file for complete search history.

(56) References Cited

U.S. PATENT DOCUMENTS

| | | | | |
|---|---|---|---|---|
| 4,926,152 | A * | 5/1990 | Ito | H01F 27/327 336/198 |
| 5,349,320 | A * | 9/1994 | Suzuki | H01F 27/02 336/107 |
| 5,685,065 | A * | 11/1997 | Suzuki | H01F 38/12 123/634 |
| 5,764,124 | A * | 6/1998 | Nakamichi | H01F 38/12 336/107 |
| 7,131,183 | B2 * | 11/2006 | Burchett | H01F 38/12 29/602.1 |
| 2011/0000472 | A1 * | 1/2011 | Skinner | H01F 3/14 123/634 |

(Continued)

FOREIGN PATENT DOCUMENTS

| | | | | |
|---|---|---|---|---|
| DE | 10 2010 017 902 | B4 | 8/2012 | |
| DE | 102011082232 | A1 * | 10/2012 | H01F 38/12 |

(Continued)

*Primary Examiner* — John M Zaleskas

(74) *Attorney, Agent, or Firm* — Bose McKinney & Evans LLP

(57) ABSTRACT

An inventive ignition coil has a transformer that includes a primary coil, a secondary coil and a core formed from stacked metal sheets. A plastic frame holds the sheets. A housing surrounds an interior in which the transformer is arranged and the interior is sealed with an electrically insulating casting compound. The housing comprises an interior wall bounding bounds a compartment in which a part of the core is arranged, the part of the core being outside the primary coil and the secondary coil.

5 Claims, 3 Drawing Sheets

(56) References Cited

U.S. PATENT DOCUMENTS

| | | | | |
|---|---|---|---|---|
| 2011/0259307 | A1 | 10/2011 | Oberer | |
| 2012/0299679 | A1* | 11/2012 | Kobayashi | H01F 38/12 336/90 |
| 2013/0291844 | A1* | 11/2013 | Skinner | H01F 27/022 123/634 |
| 2017/0263375 | A1* | 9/2017 | Akimoto | F02P 15/00 |
| 2017/0309397 | A1* | 10/2017 | Kawai | H01F 27/022 |
| 2018/0025837 | A1* | 1/2018 | Tridico | H01F 27/29 123/634 |
| 2019/0122815 | A1* | 4/2019 | Osawa | F02P 3/04 |
| 2019/0189341 | A1* | 6/2019 | Konishi | H01F 27/022 |
| 2019/0214177 | A1* | 7/2019 | Idogawa | H01F 27/28 |

FOREIGN PATENT DOCUMENTS

| | | | | | |
|---|---|---|---|---|---|
| DE | 102012219261 | A1 | * | 4/2014 | H01F 27/022 |
| JP | 11340065 | A | * | 12/1999 | |
| JP | 2001023839 | A | * | 1/2001 | H01F 38/12 |
| JP | 2001196248 | A | * | 7/2001 | |
| JP | 2005050892 | A | * | 2/2005 | |
| JP | 2013026560 | A | * | 2/2013 | |
| JP | 2013065743 | A | * | 4/2013 | |
| JP | 2015038337 | A | * | 2/2015 | |
| WO | WO 2015/151800 | A1 | | 10/2015 | |

* cited by examiner

IGNITION COIL

RELATED APPLICATIONS

This application claims priority to DE 10 2018 130 492.7, filed Nov. 30, 2018, the entire disclosure of which is hereby incorporated herein by reference.

BACKGROUND

This disclosure refers to an ignition coil with the features specified in the preamble of Claim 1, as is of known art from DE 10 2010 017 902 B4, for example.

Ignition coils usually have a housing, into which a transformer is inserted, which comprises a primary coil, a secondary coil and a coil core. The interior of the housing is filled with an electrically insulating casting compound, such as a casting resin.

In operation, ignition coils are exposed to considerable thermal stress. The different coefficients of thermal expansion of the various components of an ignition coil cause the casting compound to be subjected to high mechanical loads, which can lead to crack formation. Cracks that form on edges of the core, for example, can lead to premature failure of an ignition coil if they spread to the surface of the casting compound.

SUMMARY

This disclosure demonstrates a way of preventing premature failure of ignition coils due to cracks in the electrically insulating casting compound.

In an ignition coil according to this disclosure, a part of the core is outside the primary and secondary coils and that part is arranged in a compartment, which is bounded by an interior wall that extends into an interior of the housing. The interior wall can, for example, be designed integrally with an outer housing wall, from which it protrudes into the interior of the housing. If cracks form in the casting compound on the edges of the core, these cannot spread unhindered through the casting compound to its surface, as is the case with conventional ignition coils, but instead must migrate past the interior wall. This requires a change of direction of the crack, which leads to a considerable time delay in the propagation of cracks.

The core of the transformer of an ignition coil in accordance with this disclosure consists of stacked metal sheets, which are held in a plastic frame. An advantageous refinement envisages that the plastic frame in the compartment covers one side of the core facing towards the primary coil. In this way, the plastic frame forms a further obstacle to the propagation of cracks that may form on the edges of the core. It is particularly preferred for the interior wall to be arranged between the side of the plastic frame facing towards the primary coil, and the primary coil itself. There is then a gap between the interior wall and the plastic frame, which is filled with casting compound. In order for a crack to pass through this gap, it must change direction several times. This leads to a very slow crack propagation, and thus to an increased service life for the ignition coil.

A further advantageous refinement of this disclosure envisages that the plastic frame has a recess on its rear side, facing towards the primary coil, with which the interior wall engages. Advantageously this makes it even more difficult for a crack to propagate through the gap between the interior wall and the plastic frame.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
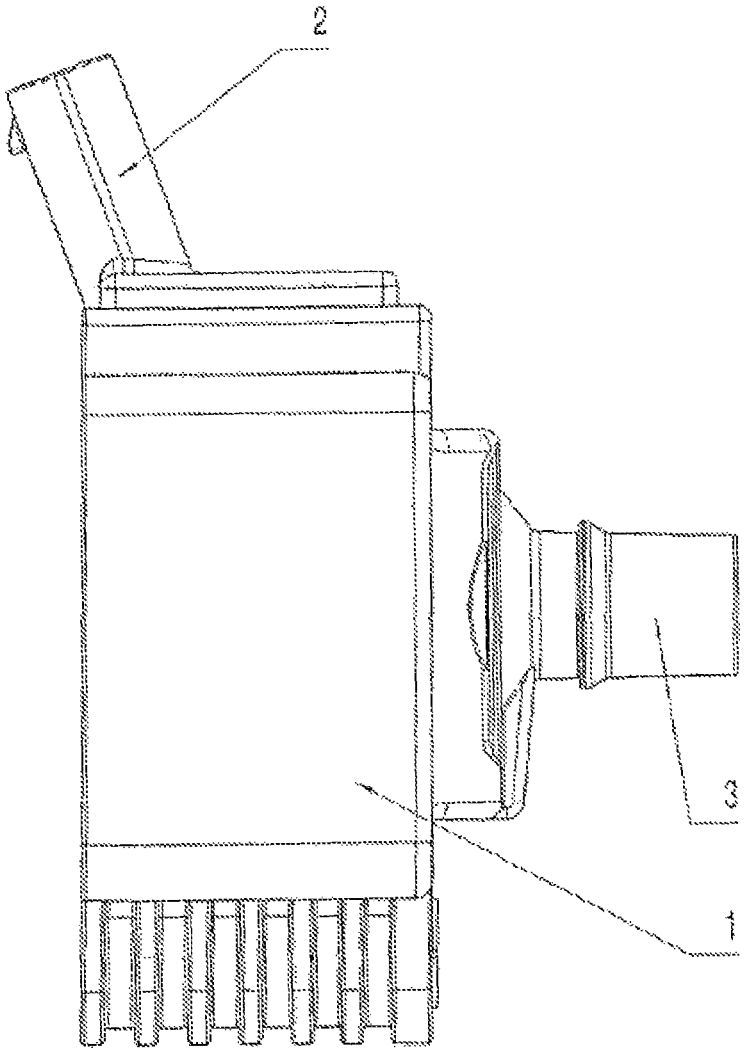
FIG. 1 shows a schematic view of an ignition coil.

FIG. 1 shows a schematic view of an ignition coil. The ignition coil has a housing 1, which forms a first connector 2 for connection to a voltage source, for example the on-board power supply of a vehicle. In addition, the housing 1 has a tubular housing part 3, which is designed as a second connector 3, for connection to an ignition plug.

Figure 2:
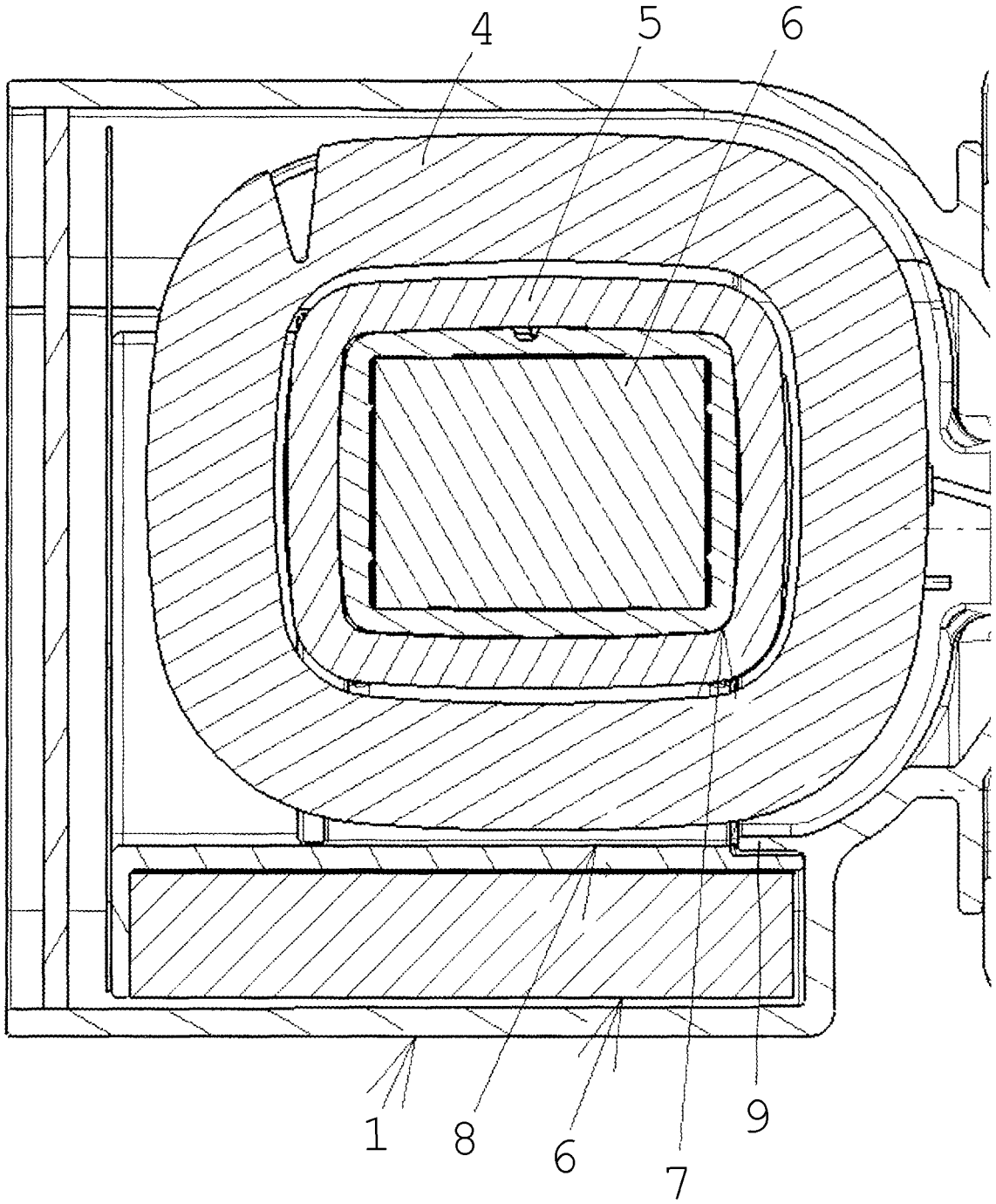
FIG. 2 shows a cross-sectional view through FIG. 1.

FIG. 2 shows a detail of a cross-sectional view through the housing 1. A transformer, consisting of a primary coil 4 wound on a bobbin 7, a secondary coil 5, and a core 6, is arranged in the housing 1. The core 6 is made up from layered transformer sheets, which are held in a plastic frame 8. A part of the core 6 is surrounded by the primary coil 4 and the secondary coil 5. Another part of the core 6 is arranged outside the primary coil 4 and the secondary coil 5 in the interior of housing 1, namely in a compartment defined by an interior wall 9.

In the example shown, interior wall 9 starts from an outer housing wall and protrudes into the interior of housing 1. The interior wall 9 can be integrally designed with the rest of the housing 1. The interior of the housing 1 is filled with an electrically insulating casting compound, such as a casting resin. The casting compound fills intermediate spaces between the various components arranged in the interior of the housing 1 and is not explicitly shown in the figures.

As FIG. 2 shows, the plastic frame 8 in the compartment covers one side of the core 6 facing towards the primary coil 4. This rear wall of the plastic frame 8 has a recess, with which the interior wall 9 engages. In this way, a gap is formed between the interior wall 9 and the plastic frame 8, which has an L-shaped profile. If cracks form in the casting compound, they can only propagate out of the compartment with great difficulty, as they have to migrate through the gap between interior wall 9 and plastic frame 8, and at the same time change their direction of propagation.

Figure 3:
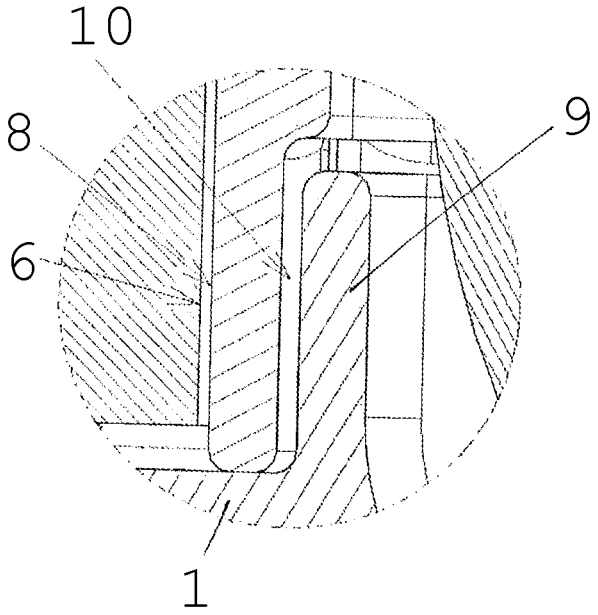
FIG. 3 shows a detail of FIG. 2.

FIG. 3 shows a detail of FIG. 2 in the region of the interior wall 9. In FIG. 3 it can clearly be seen that the plastic frame 8 has a recess in which the interior wall 9 extends. There is a gap 10 between the interior wall 9 and the plastic frame 8, which is filled with casting compound. Crack propagation through this gap 10 is made more difficult, because a crack would have to change its direction as it migrates through the gap 10.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

LIST OF REFERENCE SYMBOLS

1 Housing
2 Connector
3 Housing section
4 Primary coil
5 Secondary coil
6 Core
7 Bobbin
8 Plastic frame
9 Interior wall
10 Gap

What is claimed is:

1. An ignition coil, comprising:

a transformer having a primary coil, a secondary coil and a core formed from stacked metal sheets;

a plastic frame holding the sheets;

a housing surrounding an interior in which the transformer is arranged, wherein the interior is sealed with an electrically insulating casting compound;

an interior wall projecting from the housing into the interior and bounding a compartment in which a part of the core is arranged, said part of the core being outside the primary coil and the secondary coil, wherein the plastic frame is disposed within the compartment, and the compartment is defined by the interior wall and the housing, with the plastic frame being disposed between said part of the core and the primary coil, and said part of the core being disposed between the plastic frame and the housing, wherein the casting compound fills a gap between the interior wall and the plastic frame, and wherein the gap has a first portion extending in a first direction and a second portion extending in a second direction wherein the first and second directions are at an angle to each other;

wherein the plastic frame in the compartment covers a side of the core facing towards the primary coil; and the interior wall is arranged between a side of the plastic frame that faces towards the primary coil, and the primary coil.

2. The ignition coil according to claim 1, wherein the plastic frame has, on a surface thereof facing towards the primary coil, a recess with which the interior wall engages.

3. The ignition coil of claim 1 wherein the plastic frame is disposed adjacent to and covers a side of said part of the core disposed in the compartment and facing towards the primary coil, and the housing is disposed adjacent to an opposite side of said part of the core disposed in the compartment and facing away from the primary coil.

4. An ignition coil, comprising:

a transformer having a primary coil, a secondary coil and a core formed from stacked metal sheets;

a plastic frame holding the sheets;

a housing surrounding an interior in which the transformer is arranged, wherein the interior is sealed with an electrically insulating casting compound;

an interior wall projecting from the housing into the interior and bounding a compartment in which a part of the core is arranged, said part of the core being outside the primary coil and the secondary coil, wherein the plastic frame is disposed within the compartment, and the compartment is defined by the interior wall and the housing, with the plastic frame being disposed between said part of the core and the primary coil, and said part of the core being disposed between the plastic frame and the housing, wherein the casting compound fills a gap between the interior wall and the plastic frame, and wherein the gap has a first portion extending in a first direction and a second portion extending in a second direction wherein the first and second directions are perpendicular to each other;

wherein the plastic frame in the compartment covers a side of the core facing towards the primary coil; and the interior wall is arranged between a side of the plastic frame that faces towards the primary coil, and the primary coil.

5. An ignition coil, comprising:

a transformer having a primary coil, a secondary coil and a core formed from stacked metal sheets;

a plastic frame, holding the sheets;

a housing surrounding an interior in which the transformer is arranged, wherein the interior is sealed with an electrically insulating casting compound; and an interior wall projecting from the housing into the interior and bounding a compartment in which a part of the core is arranged, said part of the core being outside the primary coil and the secondary coil, wherein the plastic frame is disposed within the compartment, and the compartment is defined by the interior wall and the housing, with the plastic frame being disposed between said part of the core and the primary coil, and said part of the core being disposed between the plastic frame and the housing;

wherein the plastic frame covers a side of the core facing towards the primary coil, and the interior wall is arranged between a side of the plastic frame that faces toward the primary coil and the primary coil, and wherein the plastic frame has on a surface thereof facing towards the primary coil a recess which the interior wall engages; and wherein the casting compound fills a gap between the interior wall and the plastic frame, and wherein the gap has a first portion extending in a first direction and a second portion extending in a second direction wherein the first and second directions are perpendicular to each other.

* * * * *